United States Patent [19]

Luker

[11] 4,378,073

[45] Mar. 29, 1983

[54] TAMPER INDICATING CLOSURE

[75] Inventor: Edward Luker, Evansville, Ind.

[73] Assignee: Sunbeam Plastics Corporation, Evansville, Ind.

[21] Appl. No.: 279,474

[22] Filed: Jul. 1, 1981

[51] Int. Cl.[3] ..... B65D 51/04

[52] U.S. Cl. ..... 215/237; 215/305

[58] Field of Search ..... 215/237, 235, 244, 245; 222/546, 545, 556

[56] References Cited

U.S. PATENT DOCUMENTS

| | | | |
|---|---|---|---|
| 3,323,671 | 6/1967 | Minarik | 215/237 |
| 4,209,100 | 6/1980 | Uhlig | 215/237 X |
| 4,261,486 | 4/1981 | Bush et al. | 222/543 X |

*Primary Examiner*—Donald F. Norton

*Attorney, Agent, or Firm*—Fisher, Gerhardt, Crampton & Groh

[57] ABSTRACT

A tamper-indicating closure for a container in which the closure is permanently attached to a container and is provided with a cap having a dispensing opening communicating with the container which is closed by a hinged lid. Opening movement of the lid is prevented by the shape of the lid so that a separate handle formed as a unit with the lid must be deformed to a position where it can be more easily gripped for hinged movement of the lid. Once deformed, return movement of the handle to a position correcting the deformation is precluded thereby leaving the handle in a deformed position indicating that the closure has been put in a condition for opening movement.

10 Claims, 8 Drawing Figures

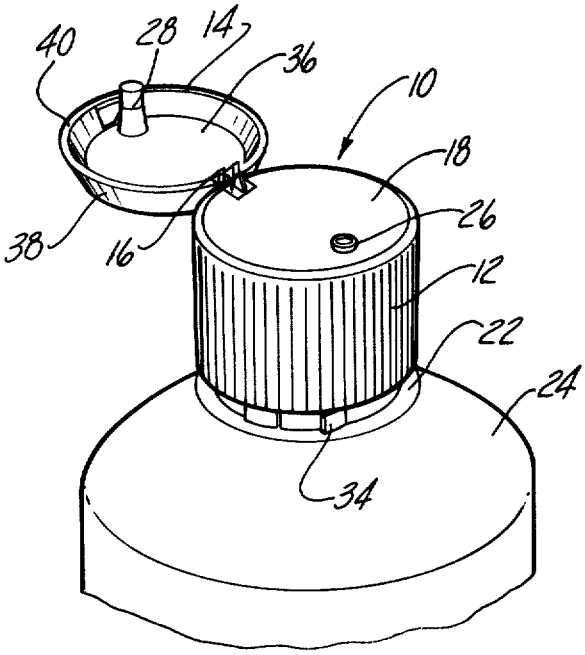
Fig-1
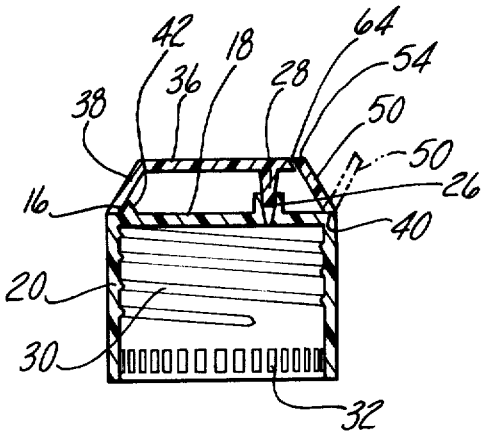
Fig-2
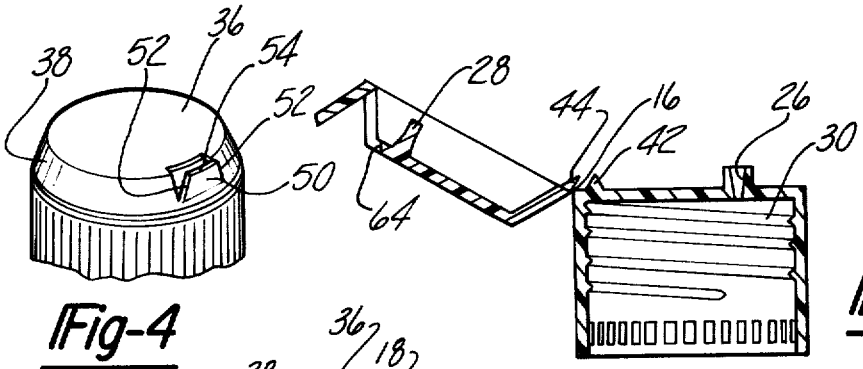
Fig-4
Fig-3
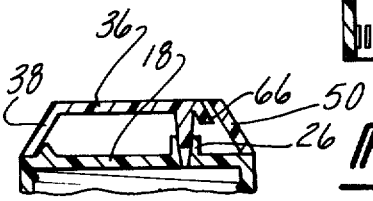
Fig-6
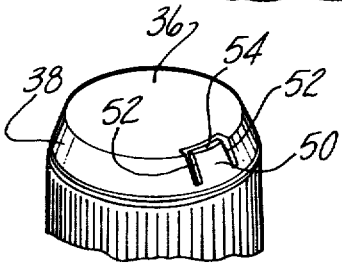
Fig-5
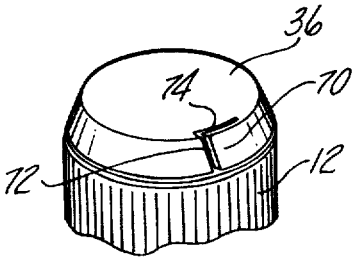
Fig-7
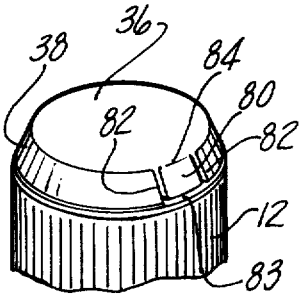
Fig-8

TAMPER INDICATING CLOSURE

This invention relates to closures for containers and more particularly tamper indicating closures.

There are a large variety of closures for containers which give no evidence that the container has been opened after it has been filled. There also are a large number of closures in which an attempt has been made to signal that the closure has been opened and reclosed. The latter type of tamper proof or tamper indicating closures most frequently require frangible portions which must be broken when the closure is opened or which have tear strips requiring removal to open the closure for the first time.

There is a need for a simple tamper indicating closure which can be manufactured and marketed economically.

It is a general object of this invention to provide a tamper indicating closure for containers of a unitary construction.

Still another object of the invention is to provide a tamper indicating closure in which all of its various parts remain intact during the opening and closing operations and which does not require separating of frangible parts or tear portions.

The objects of the invention are accomplished by a tamper indicating closure having a cap portion for permanent attachment to a container with the cap portion having a dispensing opening therethrough. A lid for closing the opening hinged directly to the cap portion to make the lid and cap portion integral and unitary. The lid is so shaped that it does not offer a gripping surface for opening movement of the lid from its closed to an open position and a handle in the form of a tab is formed integrally with the lid for that purpose. In its original, as molded position, use of the handle is not possible and requires that the handle be deformed from its original position which can be accomplished with a fingernail or thumbnail to move the handle to a second position in which it affords a gripping surface at opposite sides for opening movement of the cap. In moving the tab from its original position, the tab is bent beyond its elastic limit and takes a permanent set which cannot be removed unless the handle is moved in an opposite direction beyond its original position to correct the original deformation. Stop means are provided to prevent such corrective movement and consequently once the tab is moved to an opening position the purchaser of products in such containers can observe the tab is in a position making opening of the cap possible thereby indicating tampering and possible previous opening.

The preferred embodiments of the invention are illustrated in the drawings in which:

FIG. 1 is a perspective view of the closure embodying the invention in an open position and attached to a container only a portion of which is shown;

FIG. 2 is a cross-sectional view of the closure in FIG. 1 shown in a closed position;

FIG. 3 is a view similar to FIG. 2 showing the closure in an open position;

FIG. 4 is a perspective view at a reduced scale showing the closure in its closed condition after it has been put in a condition for opening;

FIG. 5 is a view similar to FIG. 4 showing the closure before it has been opened for the first time;

FIG. 6 is a view similar to FIG. 2 showing a modification;

FIG. 7 is a view similar to FIG. 5 showing a variation of the invention; and

FIG. 8 is a view similar to FIG. 7 showing still another embodiment of the invention.

A tamper indicating closure is indicated generally at 10 and includes a cap 12 and a lid 14 hinged to the cap 12 at 16. The cap 12, lid 14 and hinge 16 are molded as a unit to form the one-piece closure 10.

The cap 12 has a disc-shaped top 18 and a cylindrical skirt 20 forming a generally cup-shaped structure adapted to fit over the neck 22 of a container 24. The disc-shaped top 18 is provided with a dispensing orifice 26 which is adapted to be closed by a plug 28 on the lid 14 when the latter is in a closed position relative to the cap 12 as seen for example in FIG. 2.

The closure 10 is intended to be attached to the neck 22 of the container 24 in a manner preventing its removal so that the contents of the container 24 must be removed through the dispensing orifice 26. The illustrated manner of attachment is in the form of threads 30 molded on the inner surface of the skirt 20 cooperating with complementary threads, not shown, on the neck 22 of the container 24. In addition, ratchet teeth 32 are molded on the inner lower edge of the skirt 20 to engage a dog 34 on the container 24. This arrangement permits rotating the cap in a closing direction but prevents reversal for removal of the cap making it necessary to dispense contents of the container 24 through the orifice 26. Other forms of attachment for the closure 10 may also be used, that is, the closure 10 can be snapped on the neck 12 in a manner well known in the art, or it may by glued or welded to a plastic container 24 to prevent removal of the closure 10 from the container 24 and therefore removal of the contents of the container except through the dispensing orifice 26.

The cap 12 has a disc-shaped top 36 merging with a sloped, conical skirt 38 forming an outer surface resisting gripping. In the closed position the skirt 38 has a lower lip or edge 40 having an outside diameter no greater than the outer diameter of the cap 12.

The cap 12 is held in the closed position relative to the lid 14 by engagement of the plug 28 with the dispensing orifice 26 as seen in FIG. 2. If desired, additional means can be provided adjacent to the hinge 16 in the form of ears 42 molded on the top of the cap 12 which coact with the latch element 44 on the lid 14. This construction is disclosed more fully in U.S. Pat. No. 4,261,486 granted Apr. 14, 1981. The ears 42 and latch element 44 also serves to maintain the lid 14 in an open position relative to the cap to prevent interference with dispensing of the container contents through the dispensing orifice 26.

In the closed position of the lid 14 relative to the cap 12, the shape of the lid 14 prevents gripping to bring about the necessary hinging action. Opening movement is made possible by a handle or tab 50 formed in skirt 28 of the lid 14. The handle 50 can take various forms and in the illustrated embodiment in FIGS. 1 through 5 is generally rectilinear in shape having opposite sides 52 formed in the skirt 28 and an edge 54 formed separately from the disc-shaped top 36 of the lid 14. The lower edge of the handle or tab 50 is integral with the skirt 38 so that the handle 50 forms a part of the skirt 38 but is separated therefrom by the slots at the sides 52 and edge 54 separating the tab from the remainder of the lid 14.

When it is desired to open the closure 10 for the first time the tab or handle 50 can be displaced from its closed position shown in full line in FIG. 2 by inserting a fingernail or thumbnail in the slot adjacent the edge 54 and displacing the tab 50 radially outwardly to a position such as shown in broken line in FIG. 2. In this position, the handle 50 may be grasped at its inner and outer surfaces between the fingers of the hand and the lid 14 can be hinged to its open position illustrated in FIGS. 1 and 3. When the lid 14 is returned to its closed position, the handle 50 will remain at least in a partially open position because the handle portion has been permanently deformed or set although the tab may recover a slight amount and assume an intermediate position between the two positions illustrated in FIG. 2.

When the lid 14 is returned to a closed position in which the plug 28 re-engages in the dispensing orifice 26, the closure 10 will have the appearance illustrated in FIG. 4, that is, with the tab or handle 50 out of alignment with the remainder of the skirt 38 forming part of the lid 14. In that condition, it will be apparent that the closure 10 has been previously opened particularly when the package incorporating the closure 10 is displayed and can be compared with packages which have not been opened.

Once the handle 50 has been deformed or flexed to an open position, flexing of the handle 50 in the opposite direction to correct the deformation is precluded by stop means afforded by an edge portion 64 formed in the disc top 36 opposite the edge 54 of the handle 50. When an attempt is made to return the handle 50 to its original position, the edges 54 and 64 engage each other and prevent the movement that would be required to relieve and correct the deformation of the handle 50 relative to the remainder of the skirt 38 which occured during initial opening movement. It will be apparent that if necessary, an additional stop portion 66 can be molded integrally with the lid 14 as seen in FIG. 6, to prevent correction of deformation in the handle 50.

The tamper indicating means afforded by the tab or handle 50 can take other forms as illustrated, for example, in FIG. 7 in which a handle 70 has a slot 72 formed in the skirt 38 and a merging slot 74 formed circumferentially in the disc-shaped top 36. In that case, opening movement requires insertion of a tool or fingernail in the slot 72 and deformation of the handle 70 about a portion extending parallel to the slot 72 and from one end of the slot 74 to the lower edge of the skirt 38 of the lid 14. The mating edges of the slot 72 with 74 can be formed with stop portions such as stop portion 66 in FIG. 6, to prevent return or overtravel of the handle 70 required to correct the initial permanent deformation of the handle 70 to an opening position.

Another variation of the invention as shown in FIG. 8 in which a handle 80 is formed by a pair of parallel slots 82 in skirt 38 and a gap 83 between the handle 80 and the top 18 of the cap 12. Deformation of the handle 80 to an opening position requires flexing about a juncture 84 between the disc top 36 and the skirt 38. In that case return movement of the handle 80 to correct original deformation can be precluded by interference of the edges 82 with stop portions at the edges 82 similar to stop portion 66 in FIG. 6 which interfere with overtravel or return movement of the handle 80.

In all of the variations of the invention illustrated in FIGS. 5, 7 and 8 movement of the tabs or handles 50, 70 or 80 to an initial open position causes a permanent deformation which forms an indicator and gives evidence that the lid 14 has been placed in a condition for opening relative to the cap 12 thereby forming the tamper indicating means by which a consumer is made aware of possible tampering with the contents of a container.

A tamper indicating closure for containers has been provided in which a cap is permanently attached to a container and has an opening therethrough which is closed by a hinged lid so that dispensing of the contents of the container require movement of the lid. Such opening movement can be achieved by a handle forming part of the lid which requires deformation beyond its elastic limit from a closed position to a lid opening position so that the handle can be grasped to swing the lid to an open position relative to the cap. Once the handle has been deformed, it cannot be returned to its original position since stop means are provided to interfere with overtravel to correct the permanent deformation. With the handle in its deformed condition a consumer is made aware that the container has been placed in a condition for opening and remains available as a handle during repeated opening and closing movement of the package.

The embodiments of the invention in which an exclusive property or privilege is claimed are defined as follows:

1. A tamper indicating closure for a container comprising: a cap portion for permanent attachment to a container, said cap portion having an opening therethrough, a lid for closing said opening, a hinge portion joining said cap portion and said lid for movement of said lid between open and closed positions, said lid being shaped to prevent gripping for movement from said closed to said open position, a handle formed as a unit with said lid and being deformable in one direction from a first position preventing use of said handle to a second position affording gripping of said handle for opening movement of said lid, and means on said lid engaging said handle preventing deformation of said handle in the other direction beyond said first position to correct said initial deformation of said handle.

2. The tamper indicating closure of claim 1 wherein said lid has an angular skirt portion merging with the perimeter of said cap when said lid is in a closed position to prevent gripping for opening movement of said cap.

3. The tamper indicating closure of claim 1 and further comprising means to maintain said lid in closed position relative to said cap portion.

4. The tamper indicating closure of claim 3 wherein said means to maintain said lid in a closed position includes a closure for said opening in said cap portion.

5. The tamper indicating closure of claim 1 and further comprising means to hold said lid in an open position relative to said cap portion upon movement of said lid to said open position.

6. The tamper indicating closure of claim 5 wherein said means to hold said lid open are associated with said hinge.

7. The tamper indicating closure of claim 1 wherein said handle is a tab formed in the side of said lid.

8. The tamper indicating closure of claim 7 wherein said tab is attached directly to said lid at one of its edges to be bent away from the remainder of said cap upon movement to its opening position.

9. The tamper indicating closure of claim 8 wherein said hinge is disposed at one edge of said lid on a diametric line with said opening and said handle.

10. A closure for a container comprising: a cylindrical cap having a disc-shaped top and a cylindrical skirt for permanent attachment to a container, said cap having an opening through said disc-shaped top forming the only communication with the interior of said container, a lid including means for closing said opening, hinged means formed as a unit with said cap portion and lid for movement of said lid between said open and closed positions of said opening, said lid having conical sides and a maximum diameter no larger than the diameter of said disc-shaped top to resist gripping, a handle means formed integrally with said lid diametrically opposite said hinge, said handle means being moveable from an as-molded position to an opening position affording a grip for swinging said lid about said hinge means from said closed to said open position, said handle means requiring movement beyond the elastic limit of the material in said cap and permanent deformation upon movement to said opening position, and means on said lid engageable with said handle means and preventing deflection of said handle means from said opening position beyond said as-molded position to prevent correction of the deformation of said handle means relative to said cap.

* * * * *